United States Patent [19]

Kohlhage

[11] 4,341,100

[45] Jul. 27, 1982

[54] PORTABLE CERTIFICATE MAGAZINE

[75] Inventor: Hermann Kohlhage, Paderborn, Fed. Rep. of Germany

[73] Assignee: Nixdorf Computer AG, Paderborn, Fed. Rep. of Germany

[21] Appl. No.: 53,133

[22] Filed: Jun. 28, 1979

[30] Foreign Application Priority Data

Jul. 5, 1978 [DE] Fed. Rep. of Germany ..... 2829584

[51] Int. Cl.[3] ..... E05B 65/52

[52] U.S. Cl. ..... 70/63; 232/15; 70/DIG. 63; 70/337

[58] Field of Search ..... 70/237, 239, DIG. 63, 70/63; 232/15, 16; 221/1, 6, 154

[56] References Cited

U.S. PATENT DOCUMENTS

| | | | |
|---|---|---|---|
| 3,741,464 | 6/1973 | Verbeke | 232/16 |
| 3,773,252 | 11/1973 | Jensen | 232/15 |
| 3,966,116 | 6/1976 | Dominick | 232/16 |
| 4,113,140 | 9/1978 | Graef | 221/6 |
| 4,201,333 | 5/1980 | Oslin | 232/16 |
| 4,221,376 | 9/1980 | Handen | 221/154 |

*Primary Examiner*—Robert L. Wolfe

*Attorney, Agent, or Firm*—Krass, Young & Schivley

[57] ABSTRACT

A magazine for a cash dispensing machine including a lock which can be activated at a loading station to trip if later tampered with thereby to prevent installation of the magazine.

10 Claims, 15 Drawing Figures

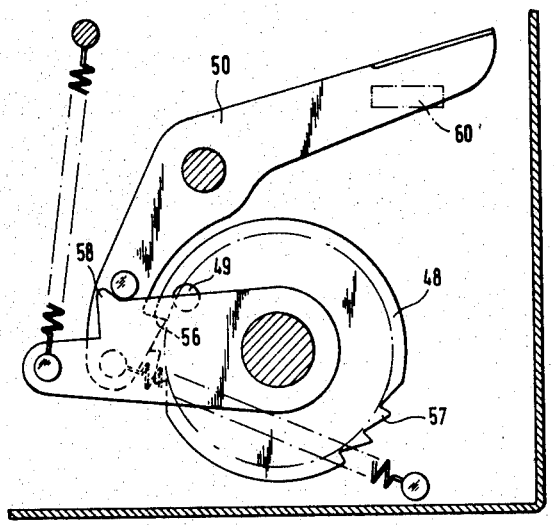
FIG. 10
FIG. 11
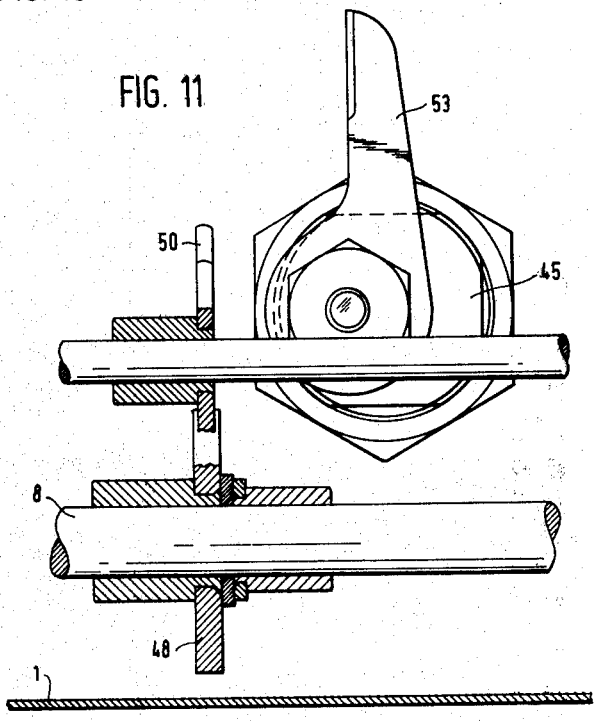

PORTABLE CERTIFICATE MAGAZINE

INTRODUCTION

This invention relates to a portable certificate magazine, preferably for mechanical or automatic certificate dispensing devices, with a magazine cover and a sealing unit which can be actuated by a key.

BACKGROUND OF THE INVENTION

For mechanical or automatic certificate dispensing devices which can be actuated by bank customers through electronic control units for the purpose of withdrawing an amount of money, the principle is known of using certificate magazines which can be sealed by a locking device and in which magazines the different denominations of money are stacked and which magazines may be inserted in the receiving frame of the dispensing device and can be locked therein. Removal slots are provided on the front side of the magazine housing, in which slots withdrawal rollers of the dispensing device engage, which rollers grasp the desired paper money bills one after another in the direction of the stack and may, for example, go into a conveyor belt in the dispensing device, which conveyor belt conveys the certificates withdrawn to a dispensing station. Certificate dispensing units are used not only in internal regions of financial institutions, but also at dispensing points which are a long distance from the financial institution at which the certificate magazines are filled with certificates. Trustworthy personnel can be employed for transporting certificates from the financial institution to the dispensing station. However, it is desirable to have the transportation of money or certificates in general as well as the filling of the certificate dispensing devices taken care of by special service contractors. However, considerable security problems can arise from this. It is true that providing locking devices in the certificate magazines is known, which permit the opening of the magazine cover only when the certificate magazine is pushed onto a key mounted fixed in the dispensing device, whereby the certificate magazine after it is opened can no longer be removed from the dispensing device and the operator has no access to the contents of the certificate magazine. However, if the person entrusted with the transporting of the certificate magazine and loading of the dispensing device should happen to copy the key mounted fixed in the dispensing device, then he can open the certificate magazine during transportation, and for example, withdraw paper money from it without this transaction being traceable to him.

SUMMARY OF THE INVENTION

The present invention is based on the problem of designing a portable certificate magazine in such a way that any unauthorized opening of the certificate magazine is rendered more difficult and, in particular, precautions are taken which make any opening of the certificate magazine by a duplicate key detectable.

This problem is solved according to the invention by having the sealing device include a locking device actuatable by a first lock and by providing a locking catch actuatable by second lock, which is coupled with the locking device and which when the lock is opened is automatically shifted from the activated position into an indicating and/or blocking position. It is particularly advantageous here for the locking catch, which is preferably coupled with a manually rotatable locking shaft in the locking device, to have a blocking element which automatically interlocks with the locking device upon the opening motion of the locking device or locking shaft from its activated position, in such a way that no second opening of the magazine cover can be done without the actuation of a key assigned to the second lock. Due to the pressure of the locking catch coupled with the locking device, any unauthorized opening of the certificate magazine automatically causes an indicating and/or blocking element to be brought into a position in which this element, which was activated after the certificate magazine was filled in the financial institution, indicates the unauthorized opening action by either an optionally detectable marking appear, or else by making the insertion of the certificate magazine into the dispensing device no longer possible, or by making any second opening action, in the certificate dispensing device for example, no longer feasible. The shifting of the locking catch into the indicating and/or blocking position cannot be prevented by the attendant provided that this attendant does not also possess the second key. Only with the use of this second key can the locking catch be released again or the blocking element of the locking catch be again brought into a position such that a second opening of the certificate magazine is possible for example after it is inserted into the certificate dispensing device.

Any manipulation of the automatically acting locking catch is excluded according to a further development of the invention by having the locking catch arranged enclosed in the inner chamber of the magazine.

A further advantageous arrangement of the certificate magazine according to the invention is given by providing a locking shaft which is rotatable by hand only after the first key is introduced into the first lock, with which shaft are coupled locking elements for the locking and opening of the magazine cover, and with which are connected release elements which, when the locking shaft is rotated into the opening position, automatically shift the blocking element, which is preferably spring-loaded and which was brought out of the indication and blocking position by the actuation of a second lock actuatable by the second key, into the indicating and blocking position. In this way it is assured that with the rotation of the locking shaft, which is rigorously required for opening the certificate magazine, the locking catch which had previously been activated automatically drops into the indicating and/or blocking position, which cannot be prevented by persons opening it without authorization. For this the locking catch may be formed of mechanical elements; but it may also consist of electromechanical, electromagnetic and/or electronic releasing and indicating elements. In any case, with the actuation of the blocking catch the second key is required for activating or for shifting it to a point outside the indicating and blocking position which indicated any unauthorized tampering with the magazine, be it by a marking or by a mechanical blocking element which presents the certificate magazine from being able to be pushed into the dispensing device or prevents it from being actuated in this dispensing position. Whereas the first key is preferably mounted stationary in the loading bench of the financial institution and in the dispensing device, the second key is safely guarded by the financial institution and is not accessible to any outsider. The said locking catch permits only one closing action each time. This means that the certificate magazine after one unauthorized opening and closing also cannot be opened again in the dispensing device until the locking catch has been reset. Therefore any undetectable tampering with the certificate magazine is impossible. But also, the security of the keys against copying need not meet overly stringent requirements, likewise, the necessity of using the "four-eyes principle" is eliminated, which can save costs.

A preferred design of the locking catch which is simple in construction and reliable in operation is given by having the locking catch include a spring-loaded release lever mounted freely rotatable on the locking shaft, which lever can be shifted into the shaft opening position against the force of the spring by a means of a release pin connected with the locking shaft, and by having a ratchet mounted rotatably and eccentric to the axis of the shaft, which ratchet, by actuation of the second key and counter to the force of a spring, interlocks with a blocking catch of the release lever outside of the indicating and blocking position, and which drops into the indicating and blocking position with the shifting of the release lever.

According to a further development of the invention, a ratchet wheel is mounted unrotatably on the locking shaft, on which wheel is fastened the release pin, and with its ratchet teeth the ratchet, equipped with a counter ratchet tooth can be locked in its indicating and blocking position in such a way that the locking shaft is locked in the opening rotation position. This makes it possible to store the certificate magazine for an intermediate period after the loading of the magazine, e.g., in the financial institute, and before it is transported to the dispensing station, without arming the locking catch and without the locking shaft being able to be rotated into the opening position, provided that the unauthorized person does not also have the second key. In this way, the certificate magazine may be "armed" only just before it is turned over to the carrier, i.e., within the view of the person carrying it, so that in case of a breakin it is possible to identify the person.

According to a further development of the invention, a locking lever is mounted unrotatably on the locking shaft, which upon the rotation of the locking shaft can be swung out into the opening position through an opening in the magazine housing and the certificate magazine be locked to the certificate dispensing unit or to a certificate loading bench. This locking lever prevents the magazine housing from being able to be stolen when it is being loaded in the financial institute or in the dispensing position or to be moved out of a loading or withdrawal device preventing access to the certificates.

According to a preferred embodiment of the invention, certificates are prevented from being stolen by means of pincers or the like through the withdrawal slits required for the proper authorized withdrawal of the certificates by having the magazine well showing or bounding the withdrawl slits constructed as a flap which can be swung around an axis of rotation and which is coupled with the locking shaft by way of a crank gear and can be swung into the interior of the housing with the closing motion of the locking shaft.

In order to prevent any unauthorized use of the first key, it is advantageous for the first lock, which is provided for the locking or unlocking of the locking shaft to be mounted fixed in the certificate dispensing device and on the loading bench.

In order reliably to prevent any unauthorized tampering with the contents of the magazine in the dispensing device or in the loading bench in the financial institute, finally, according to a further development of the invention the second lock in the magazine housing is positioned so that it is located in an inaccessible position inside the receiving frame after the certificate magazine is inserted into the certificate dispensing device.

BRIEF DESCRIPTION OF THE DRAWINGS

The invention is explained in the following on the basis of an embodiment example represented in the drawings. In these:

FIGS. 8 to 11 show the locking catch, particularly as shown in FIG. 7, in various views (FIG. 9) as well as in different actuation positions (FIGS. 8, 10, 11)

DETAILED DESCRIPTION OF ILLUSTRATIVE EMBODIMENTS

Figure 1:
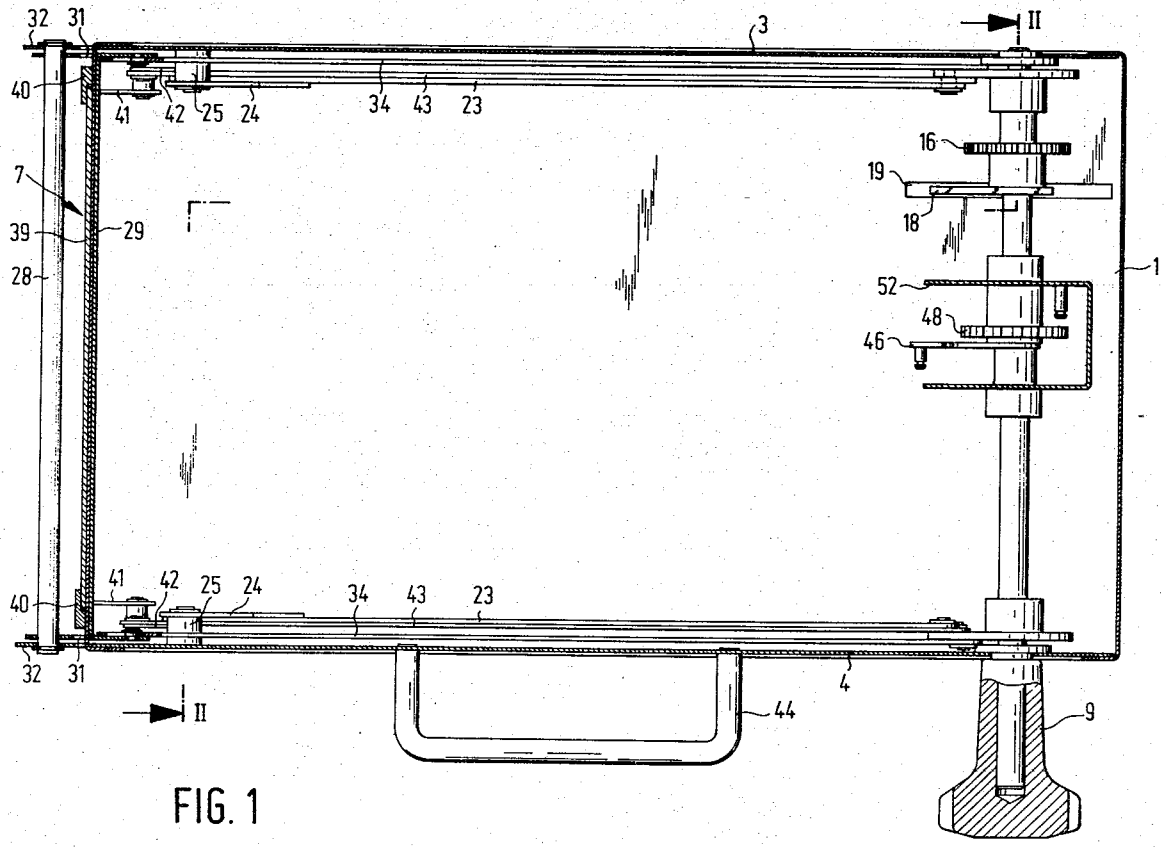
FIGS. 1 to 4 show the certificate magazine according to the invention in four different sectional views.
Figure 2:
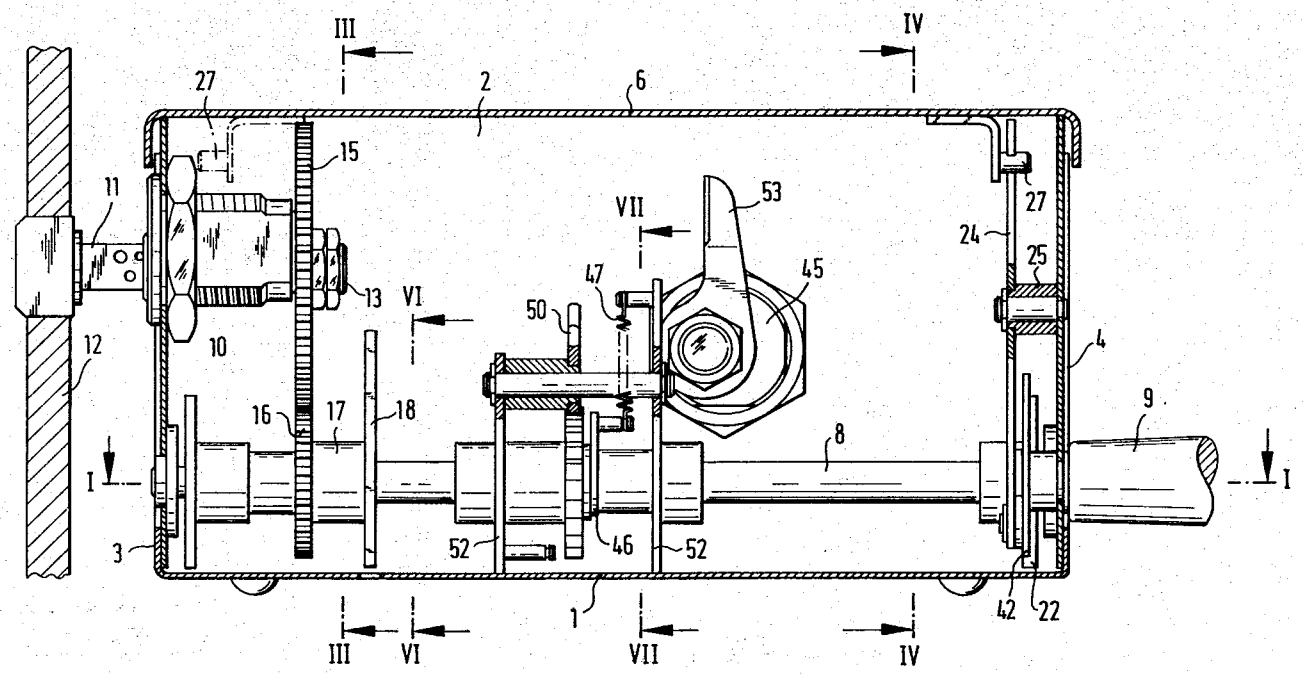
Figure 6:
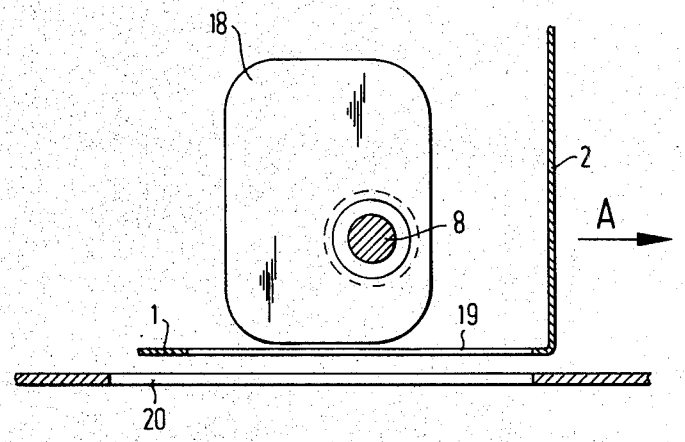
FIGS. 6 and 7 show two details of the locking device according to the foregoing figures.
Figure 12:
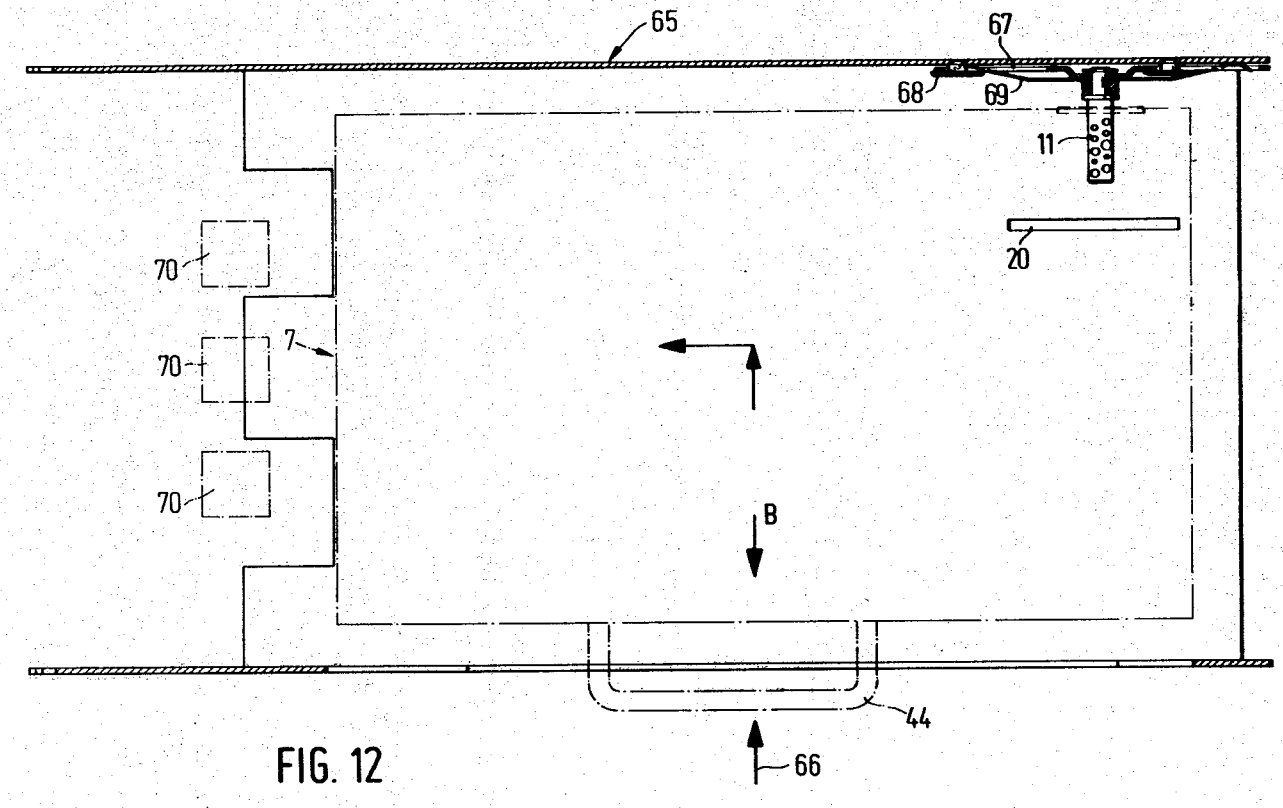
FIGS. 12 and 13 show a receptacle of a certificate dispenser, represented in a top plan view and a side elevation.

The certificate magazine shown in FIGS. 1 to 4 is constructed in the form of a rectangular container and has a bottom 1, a back wall 2, two side walls 3 and 4, a hinged magazine cover 6 which can be pivoted on hinge 5 as well as a boundary 7 on the front side to be explained in more detail later. Into the inner space of the certificate dispenser may be inserted a special inner container, not further represented, into which are loaded certificates, e.g., paper money, in stacks. In the back region of the certificate magazine a locking shaft 8 is mounted in the side wall 3, 4 which shaft is provided on the outise with a handle 9. In the side wall 3 of the certificate magazine is mounted a first lock 10 which can be actuated by a first key 11. The key 11, as symbolically represented may be mounted fixed in a side space 12 of a certificate loading bench located in the financial institution and/or in the side wall of a receiving frame located in the certificate dispensing device. As FIG. 2 in particular shows, a ratchet wheel 15 is mounted on the lock cylinder 13 of the lock 10, which wheel in FIG. 2 is in engagement by its peripheral teeth with a ratchet wheel 16 fastened unrotatably on the locking shaft 8. By inserting a key 11 into the lock 10 the lock cylinder 13 is unlocked and thereby released for a rotation by 90°-counterclockwise in FIG. 3. Therewith it is possible, by means of the ratchet wheel 15 unrotatably attached to the lock cylinder 13, as well as by means of the ratchet wheel 16 unrotatably attached to the locking shaft 8, to rotate the locking shaft 8 by 180° by the use of the handle 9-clockwise in FIG. 3. It is advantageous here to choose a 2:1 transmission ratio of ratchet wheel 15 to ratchet wheel 16. Likewise, a locking lever 18, which is represented as a unit in FIG. 6, is attached unrotatably to the locking shaft 8 by means of a bearing bushing 17 common to the ratchet wheel 16. This cornered locking lever 18 can be swung outward through an opening 19 in the magazine bottom 1 when the locking shaft 8 is rotated, namely by the opening motion of the locking shaft 8, and there can snap into a suitable opening 20 (see also FIG. 12) in the loading bench or else in the certificate dispensing device and thus lock the certificate magazine and secure it against unauthorized removal in the arrow direction A (FIG. 6) as well as the arrow direction B (FIG. 12).

Figure 3:
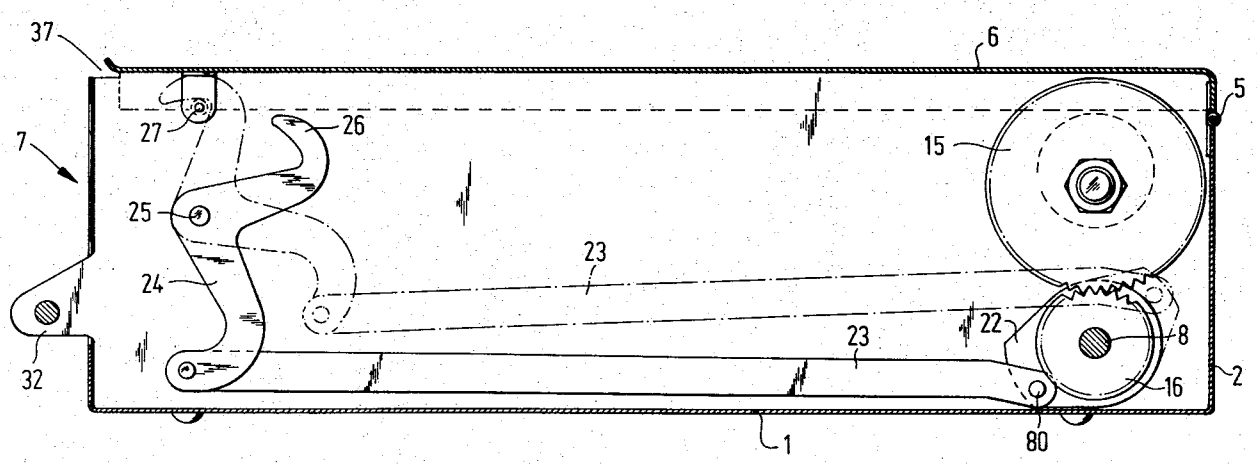

FIGS. 1, 2, 3 and 4 show the construction design of a locking device which is used for locking and unlocking the magazine cover 6 and for securing the contents of the magazine. FIG. 3 shows that crank disks 22 are mounted unrotatably on the locking shaft 8 preferably in the immediate vicinity of the side walls 3 and 4 of the magazine, which disks are coupled with connecting rods 23. On the front side of the magazine housing, each connecting rod 23 is coupled with a lock bolt 24 which in turn is mounted rotatably on a bearing bushing 25. The crank disk 22, connecting rod 23 and lock bolt 24 constitute a crank gear. When the locking shaft 8 is rotated clockwise, that is into the locking position, the connecting rod 23 and lock bolt 24 reach the position shown in a dot-dash line, wherewith the locking hook 26 slips in behind the locking pin 27 which is fastened onto the magazine cover 6.

Figure 4:
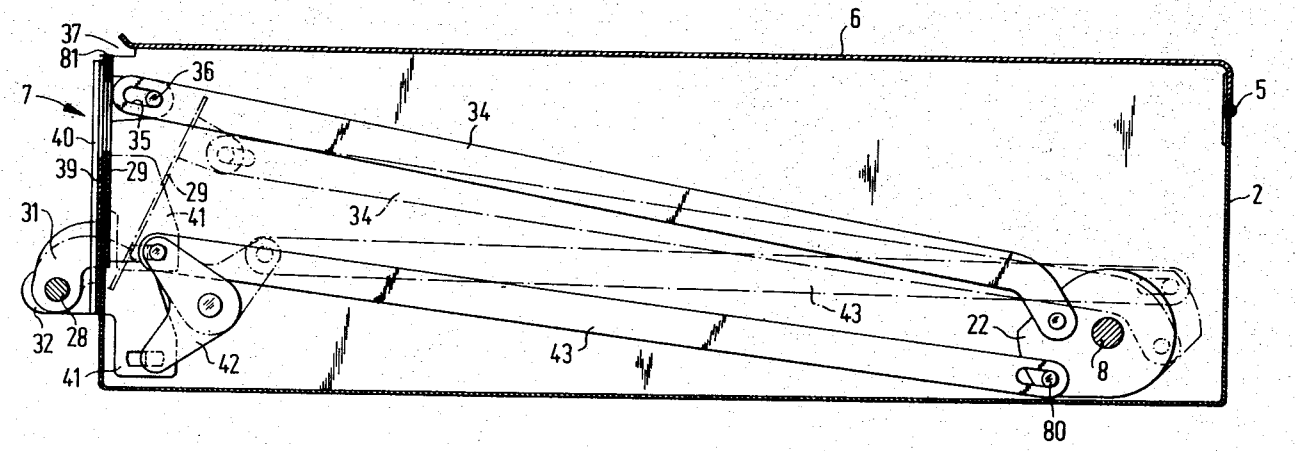
Figure 5:
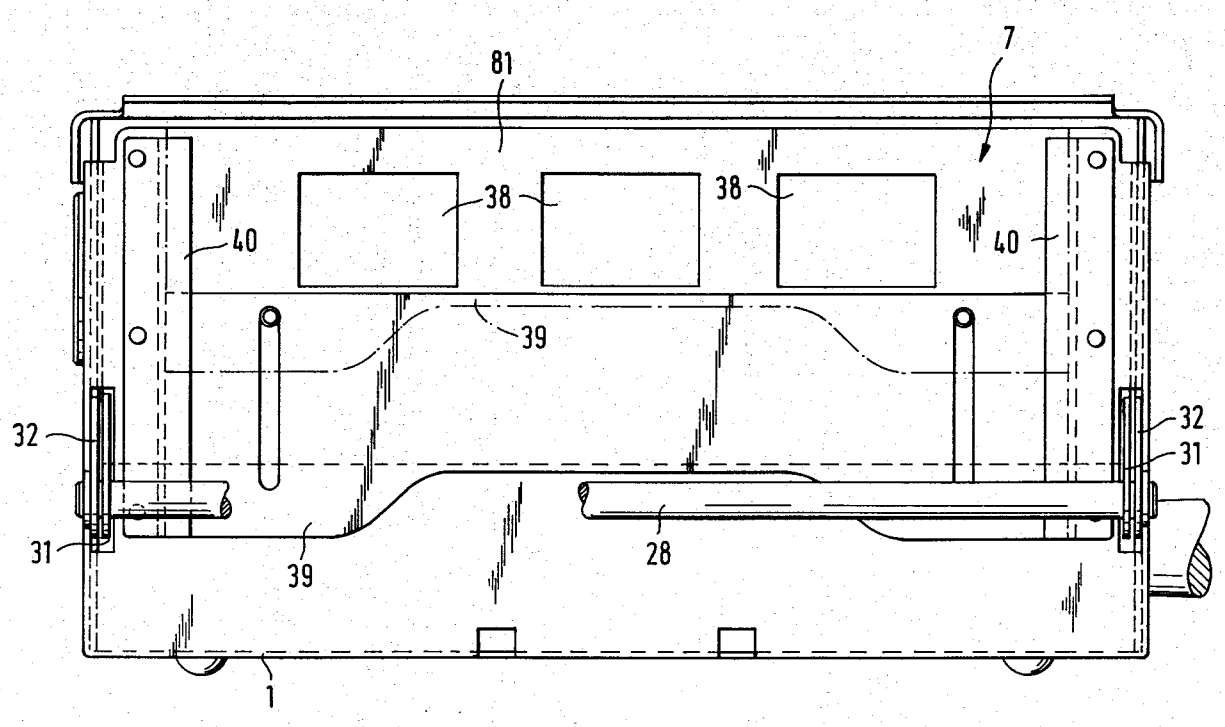
FIG. 5 shows a front view of the certificate.

The front boundary 7 of the magazine housing, as is shown by FIG. 4 in particular, is formed by a front wall 81 fixed on the housing which is provided for example with three withdrawal openings 38 and formed by a flap 29 which can be swung around the axis of rotation 28, as is clearly shown in FIG. 4. For this the flap 29, stretching over practically the whole width of the housing, has a curved bearing attachment 31 which is mounted rotatably on a bearing attachment 32 of the side walls 3 and 4 which receives the rotational pivot 28. For shifting the flap 29 into the interior of the housing that is, into the position of the dot-dash line, the crank gear described above is used, consisting of a crank disk 22 fastened unrotatably to the locking shaft 8 and of a connecting rod 34 which through a slot 35 is coupled with a coupling pin 36 of the flap 29. As FIG. 4 clearly shows, when the locking shaft 8 is rotated clockwise, that is into the locking position, the flap 29 swings inward, so that any unauthorized removal of certificates, such as through the withdrawal slot 37 formed between the upper edge of the front side and the bowed end of the cassette cover 6 is no longer possible in practice. The flap 29, like the front wall 81 in the embodiment example, possesses three withdrawal openings 38 on the front side through which, when the certificates are being withdrawn or separated, motor driven withdrawal rollers of the certificate dispensing device can penetrate inward until they lie on the stack of certificates. In order to eliminate any unauthorized removal of certificates through the withdrawal openings 38 when the certificate magazine is closed, as FIGS. 4 and 5 show a cover plate 39 is provided on the front side which shows a lateral bearing slides 40 and which is coupled by way of lateral bearing attachments 41 with at least one two-armed crank element 42 mounted to be rotatable on the container sides, as well being coupled by way of a corresponding connecting rod mounted on the bearing bolt 80, also serving for support of the connecting rod 23 (FIG. 3) of the crank disk 22, with the crank disk 22. When the locking shaft is rotated-clockwise in FIG. 4-the cover plate 39 is lifted up to the level of the withdrawal opening 38 and blocks the latter. In FIGS. 4 and 5 the operation and arrangement of the fixed front wall 81, of the flap 29 and of the cover plate 39 become clear, as does the fact that in the opening position of the magazine, the flap 29 and the front wall 81 are situated one lying against the other and their withdrawal openings 38 are aligned with one another and are ready for access, whereas in the closed position the withdrawal openings 38 are blocked on the one hand by the cover plate 39 and on the other hand the flap 29 is folded inward, presses the stack of certificates together and is removed from the removal slit 37.

The certificate magazine also has another handle 44 for carrying and for inserting the certificate magazine into the certificate dispensing device.

Figure 14:
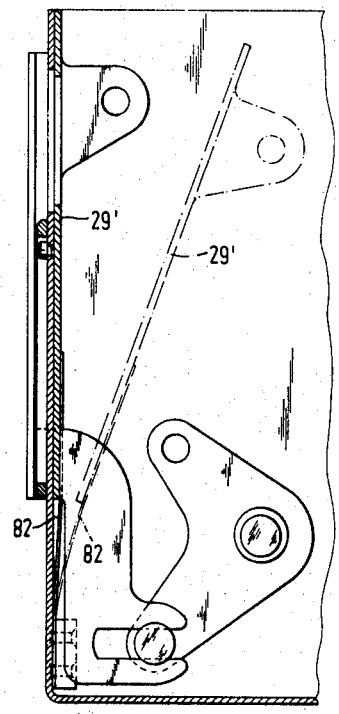
FIG. 14 shows an alternative embodiment of a sealing part of the certificate magazine similar to that according to FIG. 4.

In the alternative embodiment according to FIG. 14, the flap 29′ is designed in a more inexpensive way by having two strip-like spring plates 82, arranged in the vicinity of magazine walls 3 and 4, serve as swinging pivots for the flap 29′, each of which plates is fastened to the housing on the one hand and on the other hand is attached to the lower end of the flap 29′ in the figure. In this way a satisfactory swiveling ability of the flap 29′ is assured, and one can dispense with the swivel shaft 28, bearing attachment 31 and bearing attachment 32 according to FIG. 4.

Figure 7:
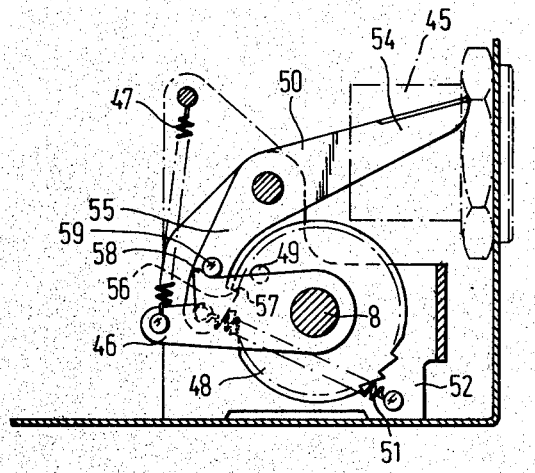

FIG. 7 shows the locking catch which has already been explained in detail in FIGS. 8 to 11. Essential elements of the locking catch are a second lock 45, a release lever 46 mounted freely rotatable on the locking shaft 8, which lever is drawn upward as seen in the figure by a spring 47, a ratchet wheel 48 attached unrotatably to the locking shaft 8 and having a release pin 49, as well as a ratchet 50 mounted freely rotatably eccentrically to the axis of the locking shaft 8, which ratchet is pressed by a spring 51 in the direction against the ratchet wheel 48. The elements of the lock catch not fastened onto the locking shaft are mounted on a frame 52 which in turn is fastened or supported on the bottom 1 of the container. A switching lever 53 (FIGS. 2 and 11) is fastened onto the lock cylinder of the lock 45 which cylinder can be rotated by a second key, not further represented, which lever presses on one lever arm 54 (FIGS. 7 and 8) of the two-armed ratchet 50 when the lock is actuated, while the other lever arm 55 has a counter locking tooth 56, which can be engaged with the locking teeth 57 of the ratchet wheel 48.

Figure 8:
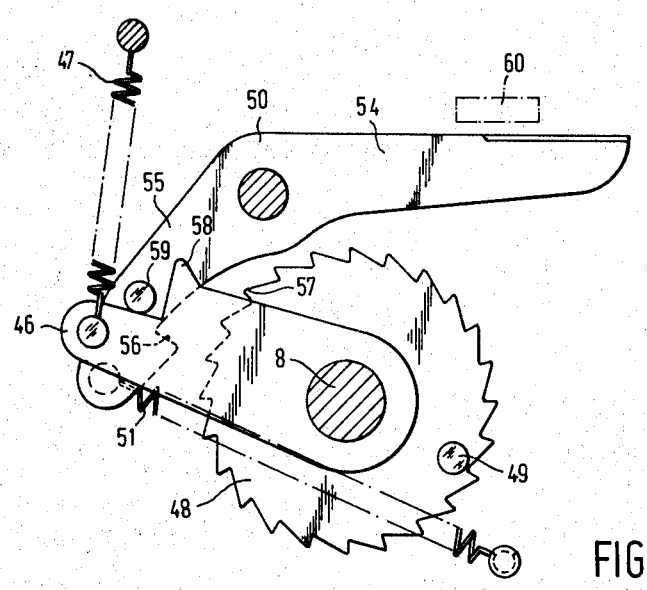
Figure 9:
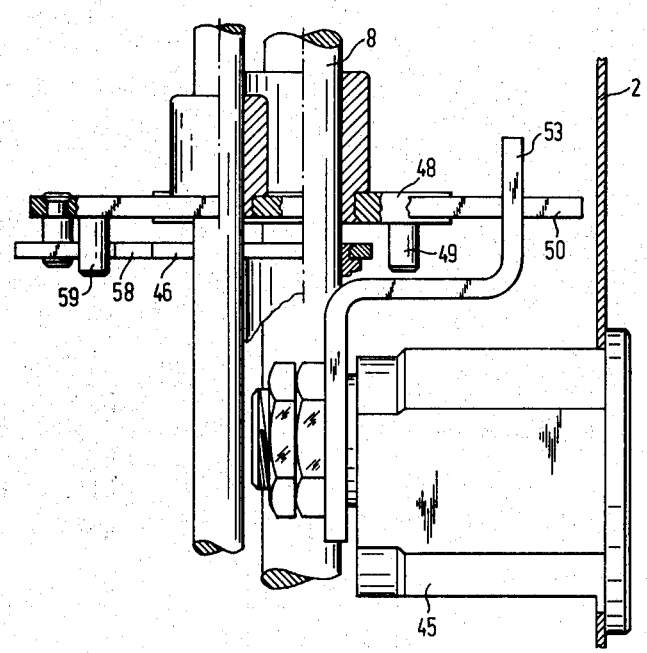

The mode of operation of the locking catch and of the whole locking device is explained on the basis of FIGS. 8 to 11. The figures show that the release lever 46 has a blocking catch 58 and that the ratchet 50 is provided with a locking pin 59 which can interlock behind the blocking catch 58. In FIG. 8 the locking catch is in the "armed" position with the magazine cover 6 closed. After the certificate magazine has been loaded, e.g., on a special loading bench in the financial institution, the magazine cover 6 was closed, and the locking shaft 8 was rotated clockwise by means of the handle 9 until the locking elements had locked the magazine cover in the manner already described and until the front side of the magazine has been secured against the unauthorized removal of certificates, likewise in the manner described. Now the first key 11 is removed from the first lock 10, after which the locking shaft 8 is secured against rotation. By actuating the second lock 45 by means of the second key, the adjusting lever 53 of the lock 45 is moved in the direction of the ratchet 50 (FIG. 7), whereby the ratchet 50 is moved clockwise far enough until the locking pin 59 snaps into the "armed" position shown in FIG. 8 by way of the blocking catch 58. In this position the locking pin 59 is retained securely, since ratchets 54 and release levers 46 are spring-tensioned against one another through their springs 51 and 47. The second key is now withdrawn and the certificate magazine can be given to the carrier and be conveyed to the certificate dispensing device. Now if the carrier has a copy of the first key 11, he can unlock the locking shaft 8 and turn it counterclockwise toward the opening position. But when it is turned, the release pin 49 of the ratchet wheel 48 moves ahead to the release lever 46 and forces this out of the blocking position, wherewith the ratchet 50 snaps into the position represented in FIG. 10 by way of the blocking catch 58. Therewith the counter-tooth 56 hooks in one of the sawtooth-shaped locking teeth 57 of the ratchet wheel 48 which lock in one rotation direction. The ratchet 50 is thus situated in the indicating and blocking position, which for example, is indicated by having the locking lever, marked in color, become visible at an indicating opening 60 of the magazine housing. Now the carrier can, it is true, rotate the locking shaft 8 again clockwise into the sealing position, but he cannot arm the locking catch again. To make this impossible even with special tools, the locking catch is enclosed on all sides in the interior of the magazine housing, which is not specially represented in the figures. After the closing of the certificate magazine, no opening action can be done a second time without the actuation of the second lock 45. Thus, when the carrier delivers the certificate magazine which has been opened without authorization, the unauthorized opening is immediately recognized purely optically, or else this opening action is indicated by the fact that the certificate magazine can no longer be inserted onto the certificate dispensing device. Here to the ratchet 50 can be employed as a blocking element by having the latter block the insertion path of a sensing element, one mounted in the dispensing device for example. Only by arming the ratchet 50 again is it possible to fully open the certificate magazine. For this the ratchet 50 moves over the blocking catch 58 by means of the second lock 45 and locks behind the blocking catch in the "armed" position.

Figure 15:
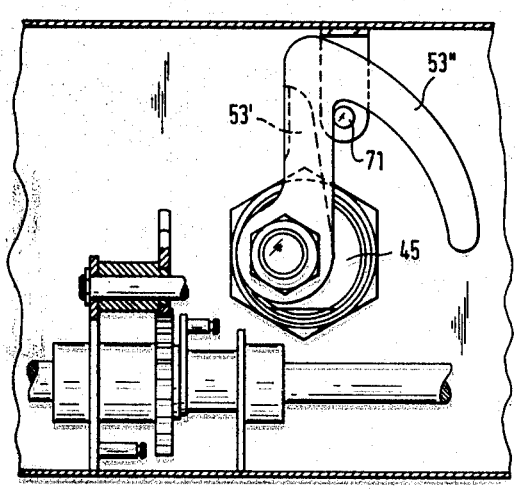
FIG. 15 shows another alternative embodiment of a magazine lock similar to that of FIG. 11.

In the alternative embodiment according to FIG. 15 the switching lever 53' has a sickle-shaped extension 53" which is essentially concentric to the lock cylinder of the lock 45, which extension essentially grasps a locking pin 71 of the magazine cover 6 in a locking manner and only after the turning of the lock 45 by means of the second key to the closed position does it release the locking pin. This prevents the "arming" of the locking catch from being forgotten. After the key 11 is introduced into the lock 10 the locking pins 27 can indeed be unblocked, but the locking pin 71 nonetheless prevents the magazine from being opened. Only after the lock 45 is closed by 45° for example, which at the same time effects the action of "arming", can the magazine cover 6 be opened.

Figure 13:
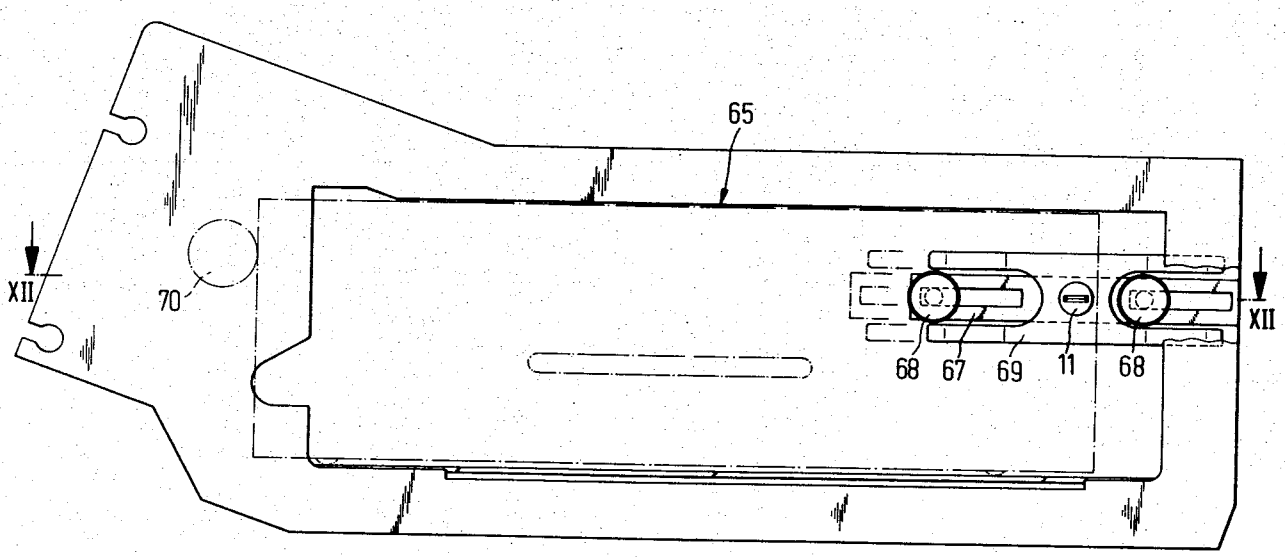

FIGS. 12 and 13 represent a receiving frame 65 fastened in the certificate dispensing device, into which frame the certificate magazine shown in dot-dash lines can be inserted from the side denoted by an arrow 66, and by being moved perpendicularly to this (see arrows perpendicular to one another) can be pushed into the receiving position. On one side wall of the receiving frame 65 a sliding carrier 67 is mounted on pins or rollers to be movable along this side wall, which carries the first key 11 projecting into the inside of the frame. The sliding carrier 67 is firmly attached to a fork-shaped leaf spring 69 which on the one hand is supported on the receiving frame 65 and on the other hand is supported together with the sliding carrier 67 on the head of the pin 68, whereby a certain braking action is achieved. This makes allowance for the ability of the certificate magazine to be pushed transversely into the removal position by having the first key 11 capable of being pushed transversely on the certificate magazine together with the first lock 10 after the coupling action. After the flap 29 is shifted over into the receiving position and after the release of the withdrawal openings 38, motor-driven withdrawal rollers 70 can come into contact with the stack of certificates. The removal of certificates can begin. In order also to secure the certificate magazine in the receiving frame, the receiving frame 65 is so constructed that, in the inserted state, the second lock of the magazine is not accessible, nor preferably is the magazine lid 6.

The embodiments of the invention in which an exclusive property or privilege is claimed are defined as follows:

1. A portable magazine for a bank note dispenser comprising:
- a housing having a cover;
- a first key lock mechanism at least partially within the housing;
- a second key lock mechanism at least partially within the housing;
- a tripping mechanism capable of assuming an armed but untripped condition and a dis-armed, tripped condition;
- indicator means associated with said tripping mechanism to show the condition thereof; and
- a latch for locking and unlocking said cover;
- the first key lock mechanism being connected to operate the latch and to trip the tripping mechanism to the dis-armed condition when operated;
- the second key lock mechanism being connected to arm and re-arm the tripping mechanism.

2. Apparatus as defined in claim 1 wherein the tripping mechanism further includes means to prevent operation of the first lock when in the dis-armed condition.

3. Apparatus as defined in claim 1 further including a shaft (8) within the housing and mechanically connected to the first key lock mechanism to be rotated thereby, and a member (18) mounted on the shaft (8) and rotatable thereby into a position partially protruding from the housing to prevent installation thereof into the dispenser.

4. Apparatus as defined in claim 1 wherein said indicator means is disposed within said housing, said housing further including a viewing port through which the position of said indicator may be viewed.

5. Apparatus as defined in claim 1 wherein said tripping mechanism is spring loaded.

6. Apparatus as defined in claim 5 wherein said tripping mechanism includes a shaft (8) connected to the first key lock mechanism to be rotated thereby, a ratchet wheel (48) rotated by the shaft (8) and carrying a tripping pin (49), a ratchet lever (46) for controlling position of said indicator means, spring means (47), (51) biasing the lever (46) and the indicator means (50) toward the armed condition whereby rotation of the ratchet (48) displaces the lever (46) to a release position to permit the indicator means (50) to move toward the tripped position.

7. Apparatus as defined in claim 6 wherein the indicator means (50) comprises a lever having a ratchet surface (56) which, when the lever moves toward the tripped position prevents further rotation of the shaft (8) and the ratchet wheel (48).

8. Apparatus as defined in claim 1 further including means mechanically connected between said second key lock mechanism and said cover to prevent the cover from opening even if said first key lock mechanism is operated.

9. Apparatus as defined in claim 1 further including bank note removal slots in an exterior surface of said housing and flap means operatively connected to said first key lock mechanism to open and close said slots.

10. Apparatus as defined in claim 1 further including a shaft (8) internally of said housing and connected to said first key lock mechanism to be rotated thereby and a control rod connected to said shaft and to said cover latch to control the condition thereof in accordance with rotation of said shaft.

* * * * *